United States Patent [19]

Wangermann

[11] 4,296,684

[45] Oct. 27, 1981

[54] APPARATUS FOR STACKING FOLDED PRINTING PRODUCTS

[75] Inventor: Jochen Wangermann, Appen, Fed. Rep. of Germany

[73] Assignee: Gruner & Jahr AG & Co., Itzehoe, Fed. Rep. of Germany

[21] Appl. No.: 111,924

[22] Filed: Jan. 14, 1980

[30] Foreign Application Priority Data

Jan. 22, 1979 [DE] Fed. Rep. of Germany ..... 2902285

[51] Int. Cl.[3] ..... B30B 1/26; B65H 29/38; B65H 31/10

[52] U.S. Cl. ..... 100/292; 271/69; 271/84; 271/176; 271/177; 271/217; 414/907

[58] Field of Search ..... 271/177, 178, 180, 181, 271/220, 221, 222, 223, 224, 84, 217, 218, 219, 69, 176, 199; 414/30, 45, 907; 100/3. 35, 292

[56] References Cited

U.S. PATENT DOCUMENTS

| | | | |
|---|---|---|---|
| 759,570 | 5/1904 | Sturtevant | 271/181 |
| 3,231,100 | 1/1966 | Faeber | 271/217 X |
| 3,617,055 | 11/1971 | Stal | 414/30 X |
| 3,667,623 | 6/1972 | Frazier et al. | 271/181 X |
| 4,067,568 | 1/1978 | Irvine | 271/176 |
| 4,197,045 | 4/1980 | Stauber | 271/220 X |

OTHER PUBLICATIONS

Sales Brochure, "Paketauslager H-500", Fehr & Reist AG, Hinwil, Switzerland, Oct., 1972.

*Primary Examiner*—Bruce H. Stoner, Jr.
*Attorney, Agent, or Firm*—Andrus, Sceales, Starke & Sawall

[57] ABSTRACT

Printing products from a printing machine are successively moved one above the other against a stop to form a stack. A leading product in contact with the stop is biased adjacent to its fold by a perpendicular force compressing the fold. A trailing product is moved on the free end face of the leading product and the perpendicular compressing force is substantially relieved upon approach of the trailing product fold to the stop. The trailing product is biased by a perpendicular force in such a manner that the trailing product is pressed adjacent its fold against the leading product. The movement of the trailing product is not hindered by the perpendicular forces and is synchronized with the build up and relief of the perpendicular forces.

8 Claims, 8 Drawing Figures

FIG.1
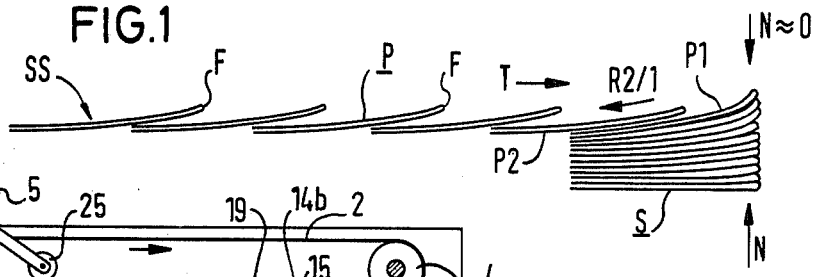
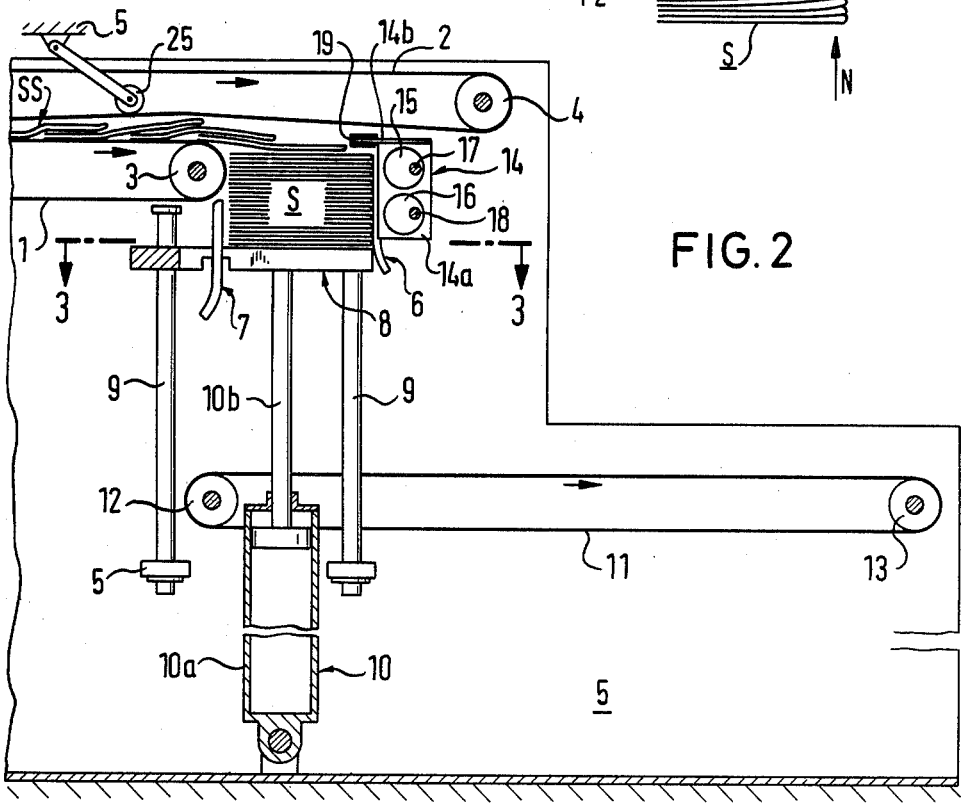
FIG. 2
FIG.3
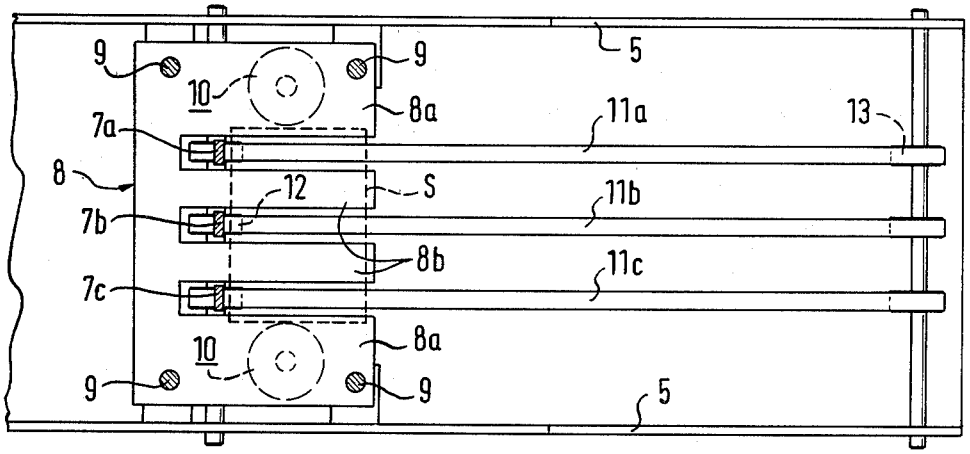

APPARATUS FOR STACKING FOLDED PRINTING PRODUCTS

BACKGROUND OF THE INVENTION

1. Field of the Invention

The present invention relates to an apparatus for forming a stack of folded printed products discharged from a printing machine and sequentially conveyed with the folds leading.

2. Description of the Prior Art

With the stack former H-500 of the firm "Fehr-Reist AG", Hinwil, Switzerland the printed product is moved on a support face or on the free face of a part stack already formed. On the thus moved product a perpendicular force is exerted to compress the part stack being built up. For exerting the perpendicular force two roller wheels run on the free end face of the part stack contacting it in a predetermined distance from the fold of the folded product, so that the fold of each product moves under the roller wheels and contacts then the stop means without being biased anymore. The contact positions of the two roller wheels have the same distance from the fold, while the distance from the fold is smaller than the distance from the trailing edge of the printing products so that the products being moved onto the part stack come into contact with the roller wheels just shortly before the stop means in order to avoid the frictional forces being induced by the perpendicular forces and hindering the movement of the product onto the part stack from becoming too high. The conveyor for the printing products does not overlap the free end face of the part stack, so that upon movement of the printing products onto the part stack the tangential forces can only be applied onto the portion of the printing product not yet overlapping the end face of the part stack. The small rollers of the roller wheels themselves can only apply very low tangential forces for the pushing of the product against the stop means.

The printing products being discharged from the folder of a printing machine in form of a product-by-product stream of overlapping products do not lie absolutely plane in the range of their folds, but build up in this range more or less. If now a plurality of printing products being fold up from paper sheets are stacked one upon the other for forming stacks the form of the stack being built up will substantially deviate from the form of a parallelepiped, especially the cross section of the part stack perpendicular with respect to the folds will become trapezoidal. Thus, for the build up of a stack it would be of advantage if for the movement of the printing products onto the stack as small as possible perpendicular forces for the compression of the folds are applied and in that for the adjustment of the stack to the form of a parallelepiped as high as possible perpendicular forces are applied.

Additionally this problem is rendered more difficult in that the friction characteristics between the printing products may vary to a considerable extent due to the differences in the size of the printed areas and the type of the used printing inks and due to the different stiffness of the paper used for the print. These characteristics cannot be considered to a sufficient extent with the known stack forming apparatus.

SUMMARY OF THE PRESENT INVENTION

In further developing the operation of the previously mentioned stack former, the present invention relates to a specific apparatus for forming a stack of printing products, with which for the adjustment of the stack to the form of a parallelepiped increased perpendicular forces can be applied to the folds, without hindering the movement of the printing products onto the stack.

In accordance with the present invention, this object is solved in that a leading product is moved on support means or on the free end face of an already formed part stack and against stop means. The leading product, which is substantially in contact with said stop means, is biased adjacent to said fold by a perpendicular force compressing said fold. A trailing product is moved on the free end face of the leading product and the perpendicular force on the leading product is substantially relieved upon approach of the fold of the trailing product to the stop means. The trailing product is then biased by a perpendicular force in such a manner that the trailing product is pressed adjacent its fold against the leading product, while the moving of the trailing product onto the leading product is not hindered by the perpendicular forces and is synchronized with the build up and relief of the perpendicular forces.

The printing product which has just come to rest substantially at the stop means, is compressed in the range of the fold, i.e. adjacent thereto, by the perpendicular force applied in this range and is pressed against the stack. This perpendicular force can be increased over the prior art, since it is substantially applied after the pushing on has been finished. This perpendicular force is relieved as soon as a trailing printing product has approached; if the trailing printing product has come to rest at the stop means, it is also biased by a perpendicular force, so that is presses the first product against the stack.

In accordance with the present invention the apparatus is characterized by conveying means for conveying the printing products sequentially along the path, stop means associated to the end of said path, support means for supporting the products of the stack contacting said stop means, at least first and second movable presser means operatively associated with said conveying means and adapted to be sequentially moved in a first position over said stack being built up and removed therefrom to a second position not overlying the stack being formed, the movements of said presser means each including between the first and second positions a component of movement directed towards the end face of the stack being built up and control means for synchronizing the movements of said conveying means and said presser means.

One of the presser means presses the stack including the printing product having previously arrived, against the support means for the stack, whereas the other presser means has moved away from the free end face of the stack to such an extent that a further printing product can be moved onto the stack. The movement of the printing products onto the stack is therefore not hindered by the compression of the folds and therewith the coherence of the stack. For the synchronizing it is possible to monitor the incoming stream of products and to control in dependency thereon the drive means for the movable presser means or to time the incoming products in correspondence to the movement of the presser means.

For the movement of the presser means there are a number of possibilities, e.g. eccentric arrangements, cam discs or the like. It has to be provided only that each presser means provides a movement in such a manner that the presser means engage the product in the range of the fold, presses the product against the free end face of the stack and is adapted to come free from the end face of the stack.

Preferably, a plurality of groups of presser means is provided, the group elements of which are arranged spaced from each other along the fold, while the group elements of the other groups of presser means are arranged therebetween, and the group elements of which are movable synchronously with each other and phase shifted with respect to the elements of the other groups of presser means. The group elements of one group of presser means are simultaneously in engagement with the stack. The movements of the groups of presser means with respect to the free end face of the stack are phase shifted with respect to each other, that the products can be pressed one after the other, while different areas of the printing products in the stack are biased with the pressing force, so that a build up of the fold is substantially avoided along the total length of the fold. With the known stacking apparatus the roller wheels always run on the same path, so that the greater part of the fold is not biased by corresponding perpendicular forces.

In the area of the fold, pressing forces are applied on the products to compress the fold. A relative displacement of the product with respect to each other is not desirable. If the perpendicular forces cannot be applied without the application of simultaneous small tangential forces, these tangential forces have to be lower than the frictional forces building up within a procuct, i.e. the friction between the presser means and the paper should always be smaller than the friction between paper and paper in the printing product in case of an ink layer having the worst characteristics with respect to frictional engagement. Thus, at least those areas of the presser means coming into contact with the printing products are coated with a slide coating.

Further apparatus claims refer to advantageous embodiments of the apparatus as according to the present invention.

BRIEF DESCRIPTION OF THE DRAWINGS

The present invention will now be described in detail with reference to the attached drawings. In the drawings FIG. 1 is a schematic side view of forming a stack from a product-by-product stream of overlapping products, FIG. 2 is a part sectional part side view of an apparatus as according to the invention, FIG. 3 is a part view on the apparatus according to FIG. 2 viewing in the direction of the arrows 3—3 in FIG. 2.

DETAILED DESCRIPTION OF THE PREFERRED EMBODIMENT

Figure 4:
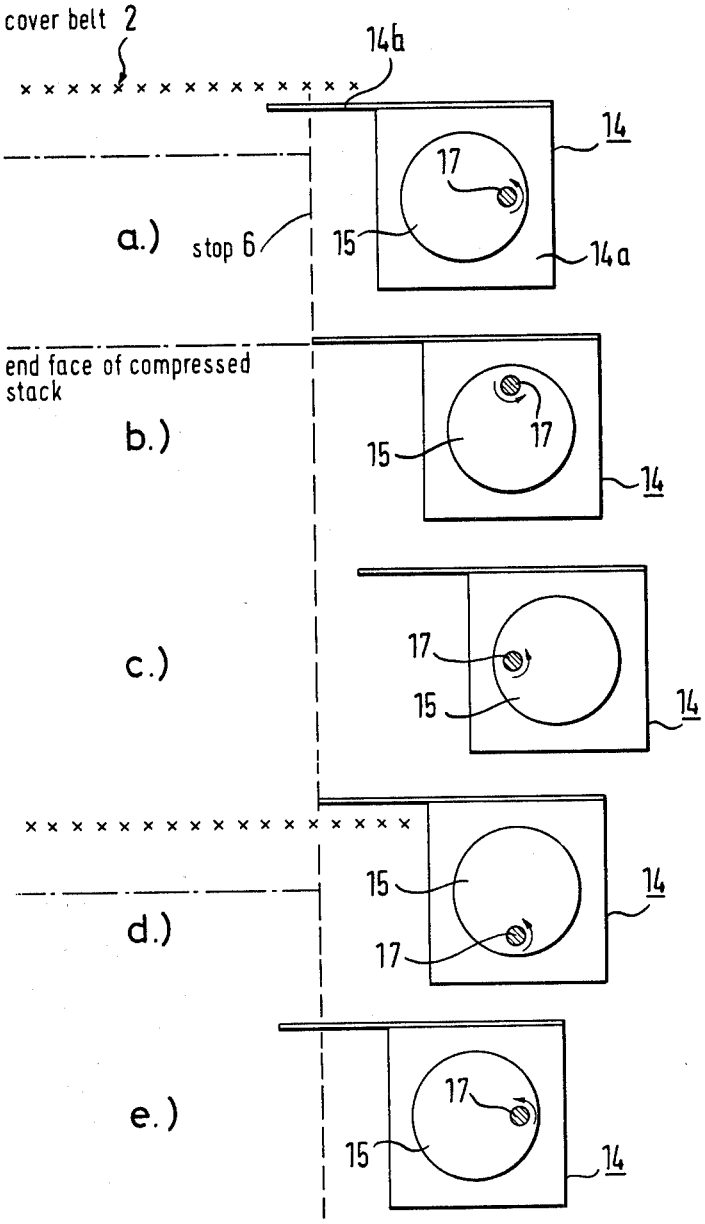
FIG. 4 is a schematic side view of the cycle of movement of an eccentrically supported presser.

As shown in FIG. 1 a product-by-product stream SS of overlapping products P is discharged from a printing machine, the products of which build up in the range of the fold. The printing products P are moved one upon the other to form a stack S. It is assumed that at the time of the build up of the stack shown in FIG. 1 the free end face of the stack S is formed by the printing product P1. For the sliding of the trailing printing product P2 onto the printing product P1 a tangential force T is necessary which has to be higher than the frictional force R2/1 between the products. The frictional force R2/1 is proportional to the perpendicular force N acting on the product P2:

$$T \geqq R2/1 = \mu_o \times N.$$

wherein $\mu_o$ is the coefficient of friction.

Additionally it has to be provided that during the movement of the product P2 on the uppermost page of the printing product P1 this page is not shifted with respect to the page lying thereunder. Whether this shifting is at hand or not is determined by the friction between the two pages of the product P1 and the stiffness of the paper. As already mentioned the frictional coefficients $\mu$ are extremely different due to different application of ink. The paper stiffness depends on the paper thickness, kind of paper and type of folding.

From the above remarks it is clear that during the movement of the trailing product by the tangential force T the perpendicular force N should be very small, for example determined by the inherent weight of the product. For avoiding the build up and therewith the deviation of the stack from the form of a parallelepiped the perpendicular force N shown in FIG. 1 should be, however, substantially higher than the inherent weight of the product, i.e. should not be substantially equal to zero.

For the conveying of the stream SS a lower carrier belt 1 and an upper cover belt 2 are provided, which move in the direction of the arrows. In the figure only the deflection rollers 3 and 4 adjacent to the stack forming are shown, which rollers are rotatably supported in a machine frame and are eventually driven.

The cover belt 2 comprises in the shown embodiment three bands 2*a*,2*b* and (2*c* see FIG. 5); it is possible, however, to provide further bands. The carrier belt 1 is also made up of bands.

Spaced from the deflection roller 3 of the carrier belt 1 stops 6*a*, 6*b*, 6*c* (see FIG. 6) are arranged, which extend transverse to the conveying direction and are spaced from each other. The distance of the stops from the deflection roller 3 corresponds substantially to the width of the printing products P to be stacked. The stops 6 define the front side of the stack S, the back side of which is defined by stops 7*a*, 7*b*, 7*c* (see FIG. 3) arranged below the deflection roller 3. At the lower ends the stops 6,7 are deflected from the front side and back side of the stack S, respectively, so that the stack can easily disengage from the stops. The products P which are conveyed for the forming of the stack S into the space defined between the deflection roller 3, the stops 6,7 and side walls not shown, are laid down on a horizontal extending table 8 or the free surface of an already formed part stack. The side walls may eventually be designed as vibrators. The table 8 is slidably supported on guiding colums 9 of the machine frame for sliding movement in vertical direction. The table 8 has the comb-like configuration as can be seen in FIG. 3. The table 8 is supported in the machine frame by two piston cylinder drives 10. With the embodiment shown the cylinder 10*a* is connected to the machine frame 5 and the piston rod 10*b* is connected to the table. The piston rods 10*b* are each connected with a broader tooth 8*a* at the edge of the comb-like table 8 respectively.

Below the table a stack conveying belt 11 comprising three bands 11*a*, 11*b*,11*c* is arranged in such a manner that upon lowering of the table from the upper position shown in FIG. 2 the bands 11*a*, 11*b*,11*c* engage between the broader teeth 8*a* and smaller teeth 8*b* in the manner shown in FIG. 3. The table 5 can be lowered to such an extent below the upper section of the bands 11*a*, 11*b*,11*c* so that the lower end face of the stack S sits on the band and so that upon movement of of the stack conveying belt 11 in the direction shown by the arrow in FIG. 2 the stack S is moved towards the right. The left deflection rollers 12 of the stack conveying belt 11 also engage in the spaces between the teeth and are supported in the machine frame as are the right deflection rollers 13 of FIG. 2. No special reference numbers are attributed to the axes of deflection rollers 3,4,12,13.

At the front side of the stack to be formed a plurality of pressers 14 are arranged in association to the stops 6*a*,6*b*,6*c*. These pressers comprise a presser body 14*a* and a press finger 14*b* connected thereto and extending horizontally. The presser body 14*a* is supported by two eccentrics 15,16 on two synchronously rotatable shafts 17 and 18, respectively, being arranged vertically one above the other. The eccentric directions of the two eccentrics are the same. With the shown embodiment the presser 14 is supported on two shafts 17,18 to provide the horizontal alignment of the press finger 14*b* coming into contact with the products.

The press finger 14*b* is provided at its surface area coming into contact with the printing products B with a slippery coating 19 to keep the friction between the printing products and the press finger as low as possible, so that the press finger can apply onto the printing products only low tangential forces. Preferably plastics, especially polytetrafluoroethylene, are used as a coating material to be applied on the lower side and eventually on the upper side of the press finger. For the sake of clearness in FIG. 2 only one presser on the shafts 17, 18 is shown.

Figure 5:
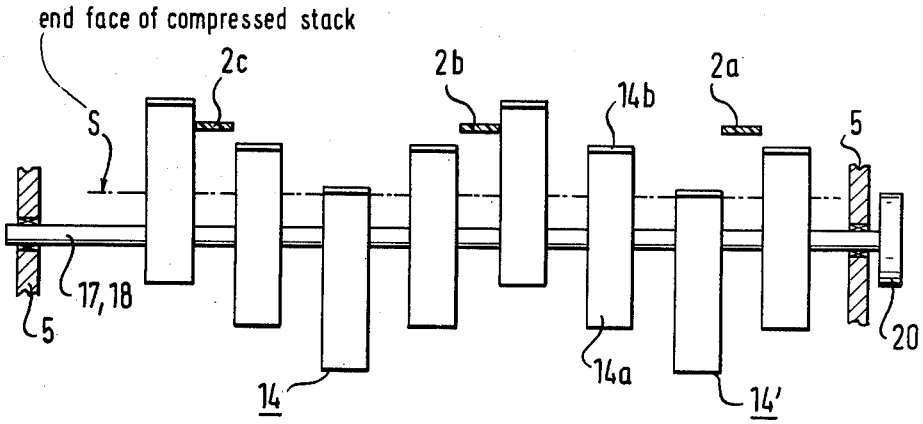
FIG. 5 is a side view of four groups of pressers viewing the front side of the stack.
Figure 6:
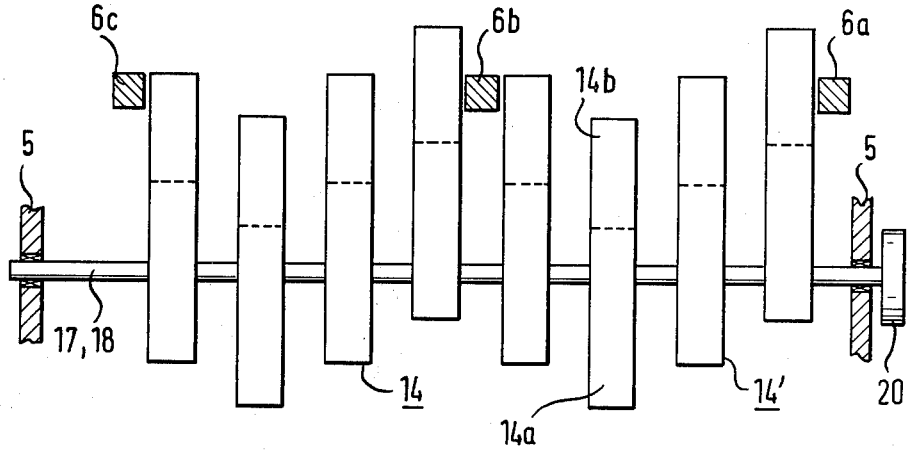
FIG. 6 is a view from above of the pressers according to FIG. 5.

As can be learned from FIG. 5 (view on the pressers in the direction towards the front side of the stack) and FIG. 6 (view of the stack end face from above) with the shown embodiment eight pressers 14 are provided, the eccentric direction of which is shifted by 90° each along the shaft 17, 18 respectively. Therefore, two pressers are always in the same phase of their movement, for example the pressers 14 and 14' in FIGS. 5 and 6.

The presser shafts 17,18 are driven via drive wheels 20 by a presser drive 21.

In FIG. 4 the cycle of movement of a single presser 14 is shown; for the sake of clearness only the eccentric disc 15 and the shaft 17 are shown together with presser body 14*a* and press finger 14*b*.

Figure 7:
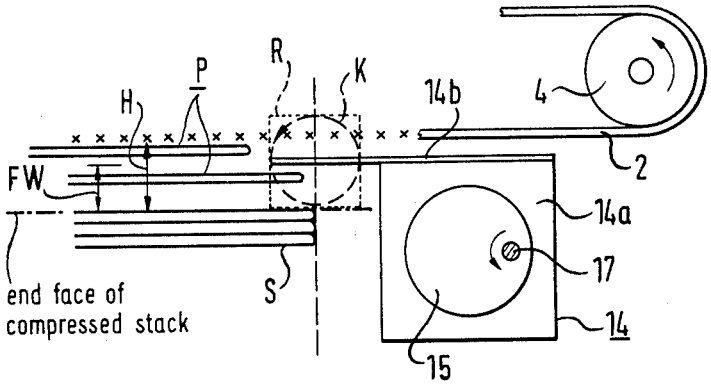
FIG. 7 is a schematic part side view for the illustration of the movement of a presser relative to the cover belt of the conveyor means and to the incoming products.

The angle of rotation from part figure to part figure in FIG. 4 amounts to 90°. In FIGS. 4 and 7 the level of the upper cover belt 2 is shown by crosses, whereas the compressing level is shown by a dash-pointed line. The position of the stop plane of the stops 6*a*,6*b*,6*c* and therewith the front side of the stack S is dashed.

Upon reaching of the desired stack height of the stack S the stream SS has to be interrupted; to achieve this it is possible either to stop the drives 22 and 23 (compare FIG. 8) of the carrier belt 1 and the cover belt 2, respectively or an interrupting means to interrupt the product-by-product stream is associated to the apparatus shown in FIG. 2. An interrupting means which can be used in the present case is disclosed in the German DE-OS 26 40 481 published on Mar. 16, 1978. Such an interrupting means can provide a defined gap, the length of which is sufficient for the lowering of table 8, the movement of stack S and the lifting of table 8. In the block diagram according to FIG. 8 the interrupting means has the reference No. 24.

As can be seen in FIG. 2 there is also an detector 25 provided, which scans the printing products conveyed into the stack forming space and generates for each product a corresponding signal to control means 26 shown in FIG. 7. For example the counting roller shown in DE-OS 26 40 481 can be used as a detector.

DESCRIPTION OF OPERATION ACCORDING TO FIGS. 1-8

Figure 8:
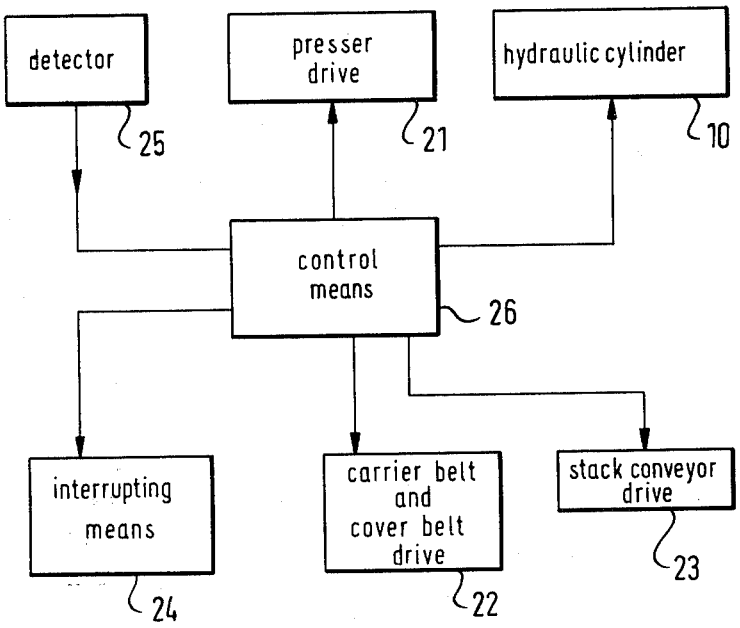
FIG. 8 is a block diagram for representing the cooperation of measuring means and drive means with the control means.

With special reference to FIG. 7 and the block diagram according to FIG. 8 the operation of the stack forming apparatus according to FIG. 2 shall now be discussed in detail. As can be derived from FIG. 7 the free edge of the press finger 14*b* of each presser 14 describes a circle K, the radius of which is defined by the eccentricity of the eccentric 15 with respect to shaft 17. The circle K is intersected by the cover belt 2 arranged above the stream SS substantially along a quarter of a circle. After rising of the finger 14*b* over the plane of the lower fraction of the cover belt 2 the press finger 14*b* engages with the upper side of the printing product P. The synchronization between the pushing movement of the product P by the carrier belt 1 and the cover belt 2 on one hand and the movement of the presser 14 on the other hand is achieved in that the control means 26 computes in dependency on the output signal of the detector 25 and the predetermined distance of the detector 25 from the stop 6 and from the conveying speed of the belts 1 and 2 moving with the same speed the necessary phase shift and controls the presser drive 21 in dependency thereon. Tests have shown that the overlap of the press finger 14*b* over the products P should correspond substantially to the situation shown in FIG. 7 (overlapping width equal to 10 mm). As can be seen in FIG. 7 the press finger draws the product overlapped and contacted by it against the stack. Thus, the press finger is theoretically in contact with the product along an arc of a circle of substantially 135°. After having reached the maximum pressing force the press finger disengages the fold of the product P having been pressed by it against the stack S. With the shown embodiment the two pressers 14, 14' cooperate. If eight pressers are provided, during one rotation of the shaft 17, 18 four products P can be layed onto the stack. Since the phases of contact of the four groups of pressers do overlap, the stack is during the formation of the stack always biased by at least two press fingers 14*b* against the table 8. Table 8 itself is pressed by the piston cylinder drives 10 against the press fingers, so that on one hand the table can give way during the pressing along the resilience travel FW and on the other hand this oscillation can be dampened to keep the resilience travel small. Between the stack end face in the compressed state, which is shown in FIG. 7 by the dash-pointed line, and the lower friction surface of the cover belt 2 there is a space of the height H (FIG. 7) at hand, in which without the build up of perpendicular forces (N=O) the pushing of products P onto the stack is possible, whereas at the end of the pushing movement a relative high perpendicular force can be applied onto the fold. The height H can be for example 12–15 mm. The slide coating 19 on the press finger **14*b* provides that during the movement of the press finger 14*b*** along the circle K the tangential forces on the products can be neglected.

When the counting of the output signals of the detector 25 by the control means 26 leads to the result that the stack S has reached its desired height, the control means 26 relieves the piston cylinder drives 10, activates the eventually deenergized drive 23 of the stack conveying belt 11, so that the finished stack can be moved. Thereafter the piston cylinder drives 10 are again connected with pressure source, so that the table 8 returns into its loading position.

The square R being shown in FIG. 7 and enveloping the circle K is to indicate that the press fingers do not necessarily have to perform circle movements due to eccentric arrangements. Other arrangements are conceivable, for example cam disks, with which the free edges of the press fingers can be moved along squares.

It is also possible to provide still more pressers 14 and to provide more stops between the pressers. It is further possible to arrange some of the pressers adjacent to each other without the intermediate arrangement of stops. Further a greater number of bands can be used in the belts. Other detectors can be used for the detection of single products. Further, it is also possible not to control the presser drive 21 in dependency on the detection of the incoming products in the product-by-product stream, but to time the stream by appropriate timers, so that the printing products are conveyed in an appropriate phase relation to the pressers constantly performing their movement. If it is necessary, the stops 7 can be extended up to the stack conveying belt 11. The free ends of the stop 6 define the maximum height of the stack. If necessary between the bands of the stack conveying belt 11 or at the side of the conveying belt 11 support elements for the moving stack can be provided.

Instead of the hydraulic support of the table 8 a spring elastic support of the table 8 with respect to the machine frame 5 can be performed, for example by flat coil springs.

Further it is possible to arrange the presser bodies above the press fingers. The construction shown in FIG. 2, with which the pressers are associated to the front side of the forming stack, lead, however, to a relative low height for the stack forming apparatus.

The inventive apparatus provides that the forming stack can only expand along the resilience travel FW shown in FIG. 7. In case of four groups of pressers 14 (FIG. 5 and FIG. 6) the resilience travel FW corresponds to a center angle of 90° of the circle K. After withdrawal of the press fingers **14*b*** of a pair of pressers from the end face of the compressed stack, i.e. by further rotation from the position shown in FIG. 4*b*, the press fingers **14*b* of the trailing pair of pressers are retarded by 90°, i.e. are in the position shown in FIG. 7, so that the stack S can be lifted under the influence of the hydraulic cylinders 10 into contact with the press fingers 14*b*. During the lifting the press fingers 14*b* of the trailing pair of pressers 14 approach the stack having been lifted relatively thereto, so that the resilience travel FW shown in FIG. 7 is the theoretical maximum one, whereas the actual resilience travel in case of the circle K will be smaller in correspondence to the movement of the press finger 14*b***, while in case of the square path R the actual resilience travel will correspond to the value FW shown.

If the pressers are associated with the stack end face in the upper end of the stacking space, in all cases a synchronizing of the movement of the press finger **14*b*** with the advancement of the products P is necessary.

What is claimed is:

1. Apparatus for forming a vertical stack from folded printing products sequentially conveyed along a path with the folds in the leading position, said apparatus comprising conveyor means (1, 2) for defining the path and for conveying the products (P) sequentially therealong:

stop means (**6*a*, 6*b*, 6*c*) interposed in the path and toward which the products move support means (8**) adjacent said stop means for receiving the sequentially conveyed printing products in a vertical stack with the folds abutting said stop means:

pressing means (14–20) operatively associated with said stop means, said pressing means including at least three groups of presser members (14, 14') arranged in spaced relationship along said stop means and across said path; said presser member groups having drive means (21) for driving said presser members in an endless path, said path having a first upper position in which said presser members overlie the product stack, a second, lower position in which said presser members contact and press the stack on the support means, and having a portion in which said presser members have a component of motion, when in contact with the stack, drawing the product toward the stop means; the movements of said presser member groups being phase shifted with respect to each other such that one group returns from the lower position to the upper position when a second group overlies the product stack and a third group presses the stack: and control means coupled to said conveyor means and drive means for synchronizing the supply of the printing products with the operation of said pressing means.

2. The apparatus as in claim 1 wherein a presser member group includes a presser body (**14*a*) coupled to said drive means (21) and having a pressing finger (14*b***) contacting and pressing the printing products.

3. Apparatus as claimed in claim 2 wherein said drive means includes a pair of synchronously rotating shafts (17, 18) having eccentrics (15, 16) mounted thereon, said eccentrics being rotatably mounted in said presser body (**14*a*) such that the free end of the presser member finger (14) describes, in a plane perpendicular to the edge of the stack abutting said stop means, a circular path (K), the eccentric direction of said eccentrics (15, 16**) for different presser member groups being circumferentially shifted with respect to each other.

4. The apparatus as in claim 1 wherein each group of presser members comprises two presser members (14, 14').

5. The apparatus as in claim 1 wherein at least those areas of the presser members (14) coming into contact with the printing products (P) are coated with a low friction coating (19).

6. The apparatus as in claim 1 including a detector (25) for detecting the printing products (P) conveyed toward said stop means, the output of said detector being connected to said control means for controlling said drive means for said pressing means.

7. The apparatus as in claim 1 wherein said apparatus has a machine frame, wherein said conveyor means defines a planar path, wherein said support means is adapted to be lowered with respect to the planar path and with respect to said pressing means (14), and wherein said support means is resiliently supported in said machine frame (5).

8. The apparatus as in claim 1 wherein said conveyor means (1, 2) includes a conveyor (2) positioned above the vertical stack.

* * * * *